United States Patent [19]

Rhoads

[11] Patent Number: 4,913,106

[45] Date of Patent: Apr. 3, 1990

[54] VARIABLE DURATION VALVE LIFTER IMPROVEMENTS

[76] Inventor: Jack L. Rhoads, P.O. Box 830, Taylor, Ariz. 85939

[21] Appl. No.: 398,883

[22] Filed: Aug. 28, 1989

[51] Int. Cl.[4] ..... F01L 1/16; F01L 1/24

[52] U.S. Cl. ..... 123/90.49; 123/90.55; 123/90.35

[58] Field of Search ..... 123/90.35, 90.48, 90.49, 123/90.52, 90.55, 90.57, 90.6

[56] References Cited

U.S. PATENT DOCUMENTS

| | | | |
|---|---|---|---|
| 3,450,288 | 6/1969 | Wortman et al. | 123/90.48 |
| 3,498,273 | 3/1970 | Humphreys | 123/90.55 |
| 3,516,393 | 6/1970 | Dadd | 123/90.55 |
| 3,921,609 | 11/1975 | Rhoads | 123/90.57 |
| 4,054,109 | 10/1977 | Herrin et al. | 123/90.55 |
| 4,231,267 | 11/1980 | Van Slooten | 123/90.48 |
| 4,457,270 | 7/1984 | Kodama et al. | 123/90.55 |
| 4,462,364 | 7/1984 | Kodama | 123/90.55 |
| 4,475,490 | 10/1984 | Oono et al. | 123/90.48 |
| 4,524,731 | 6/1985 | Rhoads | 123/90.55 |
| 4,584,976 | 4/1986 | Hillebrand | 123/90.55 |
| 4,607,599 | 8/1986 | Buente et al. | 123/90.48 |

*Primary Examiner*—Charles J. Myhre

*Assistant Examiner*—Weilun Lo

*Attorney, Agent, or Firm*—Ralph S. Branscomb

[57] ABSTRACT

Improvements are provided to the variable duration lifter, and the valve train of which the lifter is a part, which have the effect of reducing the tapping noise of the valves at low RPM, which is characteristic of effective variable duration lifters. This is achieved by utilizing an effective length of the valve train which produces a reduced volume of the oil reservoir defined between the outer cylinder of the lifter and the internal plunger, such that when the engine operates at low RPM, the internal plunger "bottoms out" before the valve seats. This is coupled with a modified cam having a closing ramp which seats the valve more smoothly and quietly than does the conventional ramp. To further insure the quiet seating of the valve at the appropriate point of cam rotation, the bleed passageway of the lifter plunger is enlarged in cross-section in the preferred embodiment, and to reduce trauma on the underside of the lifter, a groove or flat is ground down the entire length of the external cylinder of the lifter which, by virtue of being in communication with the oil gallery, provides lubrication for the cam-following bottom of the lifter body.

11 Claims, 2 Drawing Sheets

VARIABLE DURATION VALVE LIFTER IMPROVEMENTS

BACKGROUND OF THE INVENTION

The invention is in the field of hydraulic valve lifters, and more particularly pertains to variable duration valve lifters.

Hydraulic valve lifters are a blessing because they adjust the valve train, if necessary, every time the valve seats. Variable duration hydraulic valve lifters are an improvement upon the basic hydraulic lifter which has application in high-performance engines. The radical cam of the high performance engine causes valve overlap, which is effective at improving engine performance at high speeds, but causes very rough engine performance at idling. The variable duration, or "bleed down", lifter solves this problem. The instant inventor has two prior patents on bleed-down lifters, the first of which is U.S. Pat. No. 3,921,609, issued on Nov. 25, 1975. The second is a modification and improvement on the first, and bears U.S. Pat. No. 4,524,731, issued June 25, 1985. Thorough descriptions of the purpose and functioning of bleed-down hydraulic lifters are found in those patents. The instant invention applies to these lifters as well as other types of lifters, such as the so-called "sloppy fit" lifter in which bleed-down occurs between the plunger and the outer cylinder.

Unfortunately, variable duration, or bleed-down lifters cause the engine to tick rather loudly at idling speeds. The ticking comes from the closing of the valves in their seats at a higher speed than that for which quiet operation is maintained. The accelerated seating speed in turn is caused by two separate factors.

First, bleed-down lifters cause the valve train to continuously shorten from the time the lifting cycle begins until the valve seats again. The shortening of the effective valve train while the valve is seating accelerates the impact of the valve in its seat.

Secondly, because the variable duration lifter moves forward in time the point at which the valve seats, the valve will seat at a higher point on the closing ramp on the cam. The higher point on the closing ramp is steeper and is thus bringing the valve into the seating position at a higher velocity than would be the case if the valve were to seat later as it normally would.

This invention is principally targeted toward these two problems, with the aim of reducing or eliminating valve ticking.

SUMMARY OF THE INVENTION

In the instant invention, there are four features which optimize performance of lifters at low RPM. (All lifters referred to herein are of the variable duration, or "bleed-down" type unless otherwise noted, and are referred to simply as "lifters". This includes all types of variable duration lifters).

First, to prevent the continuous shortening of the effective valve train length due to hydraulic bleeding throughout the lift cycle, the valve train is dimensioned such that the lifter plunger will bottom out in the lift cycle, before the valve seats. This terminates bleed-down for the rest of the lift cycle and thus eliminates valve acceleration on closing due to bleed-down.

Secondly, in conjunction with the first feature, a modified asymmetric cam is used which has a closing ramp designed to extend the shallow portion of the ramp forward in the lift cycle, so that the lifter is riding on the shallow portion when the valve closes, and not on the steeper upper portion.

The third feature works with the first two features and comprises a bleed passageway which is actually larger than the bleed passageways of current bleed-down lifters. Although this might seem contradictory, the fact is that the larger bleed passageway ensures that the plunger will bottom out prior to valve closure. This in turn permits the use of a longer plunger travel yielding greater reduction in valve lift and cycle duration, without encountering the problem of the valve seating prior to the seating of the plunger.

Lastly, to mitigate possible consequences of valve train trauma on the bearing surface of the lifter, a groove or flat is ground down the external surface of the lifter body which provides an oil passageway from the oil gallery to the bottom of the lifter, lubricating the surface which contacts the cam lobe. This groove is effective whether or not the lifter is the variable duration type.

DETAILED DESCRIPTION OF THE PREFERRED EMBODIMENT

The details of construction of the valve and the valve train are covered in the above-referenced issued patents, and will not be detailed again here. However, in order to understand the invention, it is necessary to have a summary understanding of three stages of the hydraulic lifter art: (1) an understanding of the workings of a basic hydraulic lifter; (2) the bleed-down function in a variable duration hydraulic lifter; and, (3), the way the improvements set forth herein function to reduce noise in a variable duration lifter.

Figure 1:
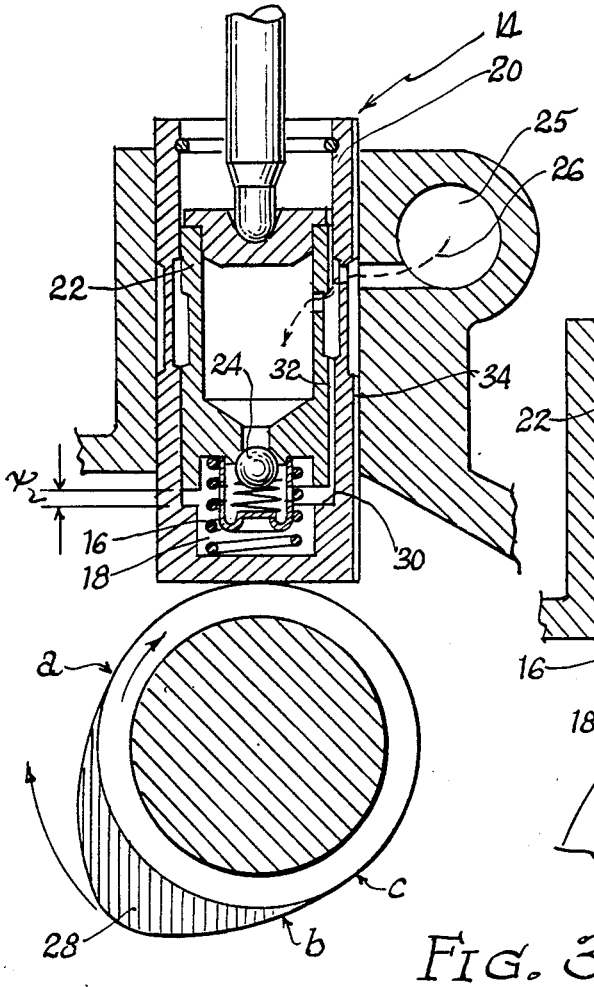
FIG. 1 illustrates the plunger of the instant invention cut away in the position in which the valve is seated.
Figure 2:
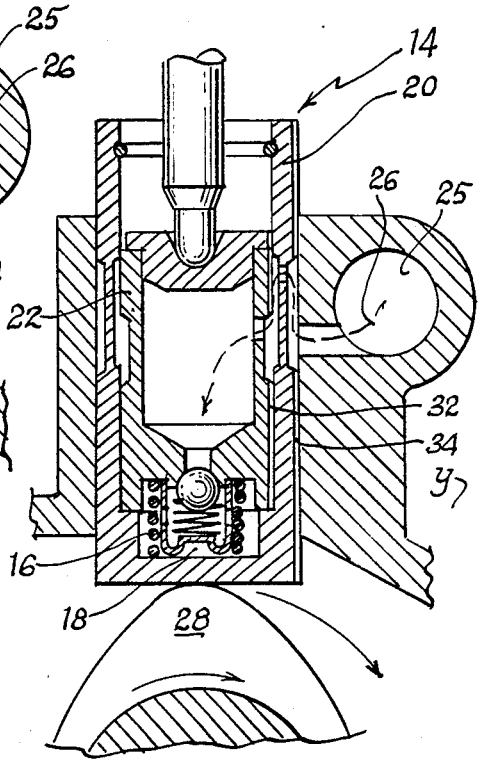
FIG. 2 is identical with FIG. 1 but illustrates a later point in the lift cycle in which the plunger has bottomed out.
Figure 6:
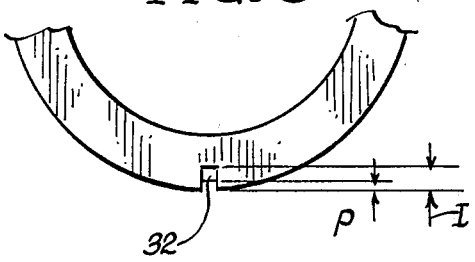
FIG. 6 is a section taken through the plunger at FIG. 5, incorporating a phantom of the prior flat ground into the plunger.
Figure 7:
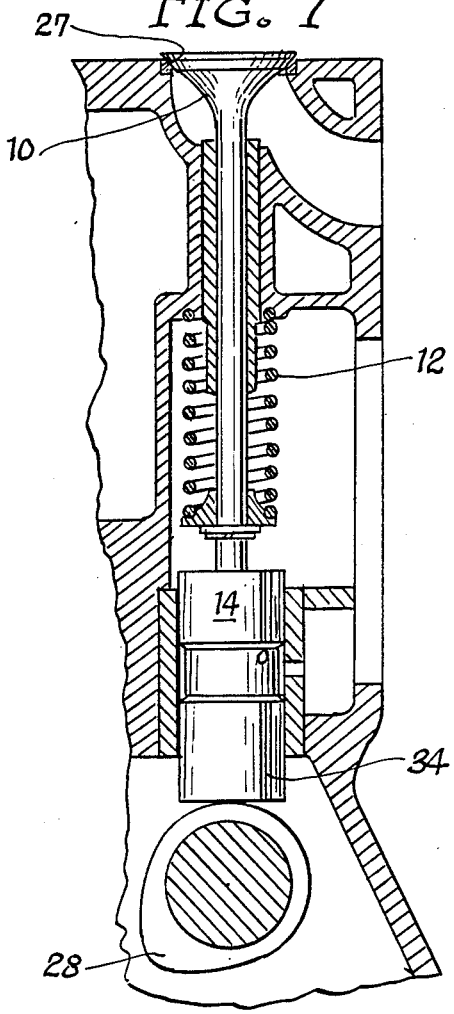
FIG. 7 is a somewhat diagrammatical partial section illustrating a very simple valve train, not having the rocker arm assembly of most modern engines, incorporating the hydraulic lifter; and, FIG. 8 is an isometric of the external cylinder of the lifter with a lubrication flat ground down the entire length of its side.

Reference is made to FIGS. 1, 2, and 6. Hydraulic lifters were invented primarily to compensate for dimensional changes in the valve train relative to the engine caused primarily by heat expansion and contraction. They have the effect of re-adjusting the length of the valve train every time the valve seats. If the valve seats slightly prematurely, the valve 10 (FIG. 7) relieves the expansion force of spring 12 from the lifter 14. When this occurs, the weak spring 16 in the reservoir 18 defined between the outer lifter body 20 and the axially slidable internal plunger 22 pushes the plunger up, unseating the ball 24 of the ball check valve, and drawing oil in from the oil reservoir 25 through the passageway indicated by the arrow 26 and down inside the reservoir 18, effectively lengthening the valve train.

Figure 4:
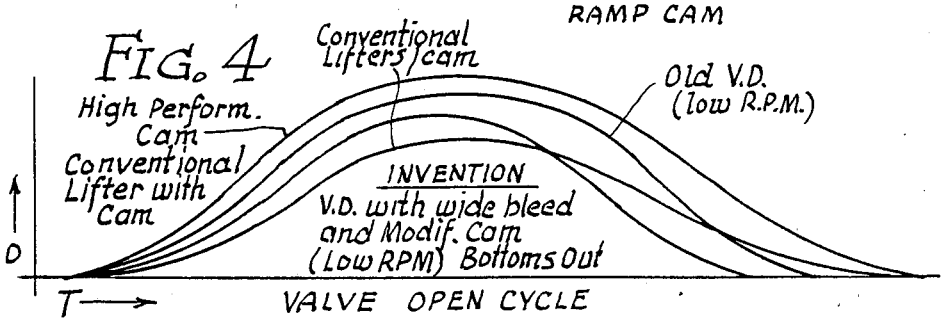
FIG. 4 illustrates the position of the valve throughout its open cycle at different engine speeds and with different lifters.
Figure 5:
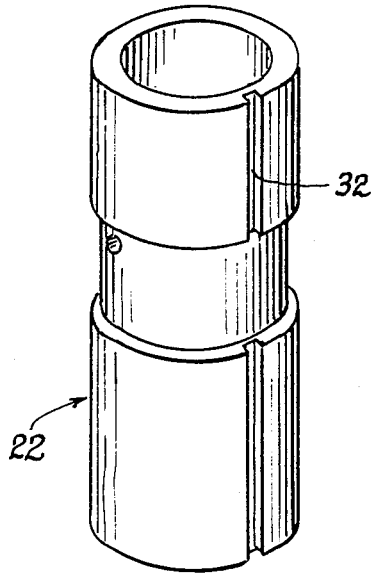
FIG. 5 illustrates in isometric the deeper flat ground into the plunger of the instant invention.

Thus the next time the valve seats, if there is no further expansion during the cycle, it will fit precisely. In practice however, even in non-bleed-down lifters there is a slight seepage of oil from the reservoir 18, so that the valve always seats snugly in its seat 27. The valve open cycle for the conventional lifter (that is, non-variable duration) is shown in FIG. 4. The opening of the valve when driven by the conventional lifter/cam is the lower curve, and is substantially symmetrical and bell-shaped.

When a radical cam is installed to improve performance, the valve opens wider and is open longer, as is indicated by the uppermost curve in FIG. 4. The valve is open so long that the exhaust valve overlaps the intake valve and vice-versa, maximizing aspiration at high speeds but causing very rough operation at idle and low speeds. By prematurely closing the valve, the bleed-down feature eliminates the low-end roughness of the engine, while not affecting high-end performance. Valve timing using bleed-down lifters currently in use, termed "OLD VD" (VARIABLE DURATION) in FIG. 4 produces a curve that falls off rapidly from the high-performance curve over the lift cycle, and terminates the lift cycle prematurely as shown, but has the disadvantage of seating the valve somewhat abruptly as indicated by the steep curve at the end of the cycle on this time-vs-distance graph.

Paralleling valve operation according to the graph of FIG. 4 is the actual engine cycling as shown in FIGS. 1 and 2. As the cam lobe 28 rotates clockwise as shown in FIG. 1, the opening ramp begins at "a". Cross-referencing to FIG. 3, it can be seen that at "a" the valve begins to open with both the normal cam contour on the left and the modified cam of the instant invention on the right.

As the cam lobe continues to rotate, the valve lifter rises to its maximum height, and begins to fall. When the lifter gets to point "b", if it is a variable duration lifter, the valve will be closing in its seat. It seats relatively quickly because the bleeding action of the bleed-down passageway 32 will continuously shorten the valve train during the lift cycle unless the lifter plunger bottoms out in its seat, which it will not do in conventional bleed-down lifters. This can be seen both from an inspection of the cam itself, and the normal cam profile of FIG. 3 (which is somewhat exaggerated). At point "b" shown on both the graph and the cam diagram, the valve is seen to be closing rather rapidly. If it seats at this point, it seats more abruptly, making an audible tap.

Figure 3:
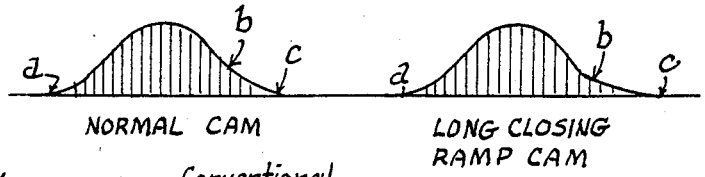
FIG. 3 illustrates diagrammatically the closing ramp of the cam to accommodate premature valve closure.

Continuing around the cam lobe, and around the profiles of FIG. 3, point "c" indicates where the valve would close utilizing the standard lifter which does not incorporate the bleed-down feature.

It is important to note that the above discussion comparing FIGS. 1 and 3 pertains to engines operating at low RPM. This generally means idling speeds, up to about 1000 RPM. As engine speed increases, point "b" will move toward point "c" on both the cam lobe and the cam profile of FIG. 3 until "b" actually reaches "c". Thus the principle thrust of the improvements of this disclosure relates to low-speed engine operation of engines using bleed-down lifters.

Low speed noise reduction is achieved by a combination of techniques. First, the shape of the cam is made asymmetric, according to the profile shown on the right side of FIG. 3. The descending or closing side of the ramp begins to flatten out much soooner in its cycle than does the normal cam, so that in order to drop the valve in the same period of time as the normal cam the beginning of the closing ramp is much steeper. This is shown in the comparison of cam profiles in FIG. 3. Asymmetrical cam designs for the purpose of easing the valve seating is not by itself new.

The second feature of the invention works closely with the first. This feature involves designing the valve train such that the height of the internal plunger in the outer cylinder is very carefully set. The dimension in question is indicated at "x" in FIG. 1 and represents the height of the plunger above its seat 30 when the valve is seated and static. This dimension is chosen in conjunction with a number of other engine parameters, including the normal engine idling and operating speed, the camshaft configuration, the strength of the valve spring 12, and the width of the bleed-down passageway as discussed below. However, the end result of considering these results is to design a displacement "x" which is sufficiently small that it will be eliminated, "bottoming out" the plunger as shown in FIG. 2, sometime during the lift cycle. The result of this is to create the curve in FIG. 4 indicated as "invention". This curve also includes the fast bleed feature, as otherwise it would follow the "Old VD" curve for the first half of the cycle, until it flattened out at the right end of the curve, in the second half of its lift cycle.

FIG. 2 illustrates the closed displacement at "y", at which point the plunger has bottomed out, as occurring by the time or at the time the valve reaches its widest open position, and the lift cycle is halfway through. However, the plunger could bottom out anytime during the lift cycle, provided it occurred before the valve actually seats. This timing is largely controlled by the size of the cross-section of the bleed passageway 32.

The bleed passageway 32 of the prior Rhoads (tm) design is ground the full length of the plunger 22. As can be seen in FIG. 6, the depth of the groove has been increased from "P", the prior art depth, which was approximately 0.004" to 0.005" with a width of 0.020", to a depth "I" of about 0.006" to 0.010", also having a width of 0.020".

The displacement "X" (FIG. 1) would generally be less than 0.050", and is currently being set at about 0.025 with successful results. There is a tradeoff between the "X" dimension and the "I" dimension, as clearly the plunger can bleed down faster if the "I" dimension is greater, permitting "X" to be larger, and vice-versa. The larger the "I" dimension, the higher the engine will have to rev before the bleed-down effect is effectively neutralized, enabling the hydraulic lifters to pump up solid and take advantage of the high performance cam.

Thus, clearly the system designer must take into account the bleed-down passageway speed and flow rates as the flow speed increases, the displacement dimension "X", and the configuration of the closing ramp of the cam as shown in FIG. 3. These things all must be factored in, in order to maximize engine performance and take full advantage of both the high-performance cam, and the bleed-down features of the lifters.

The manufacturer, or at least the manufacturer of the high-performance parts, will control the configuration of the cam closing ramp and the dimensions of the groove 32. The manufacturer may also control the effective length, and thus the displacement "X", of the valve train, but this may also be done by the engine owners if they are hobbyists. This is accomplished by making standard valve train length adjustments that are made possible in almost all internal combustion engines.

Many engines, such as those made by Chevrolet, have an adjustable valve train in which the plunger can be positioned at various spacings from the seat in the lifter shell by adjusting a locknut located in the center of the rocker arm assembly. On some engines, such as Chrysler, the rocker arm itself has an adjustable screw incorporated into the end of the rocker arm. If the screw is extended downward, the pushrod is also driven farther downward along with the plunger in the lifter body.

In engines that do not have rocker arm adjustments, the instant invention can be implemented by the introduction of longer pushrods, or adjustable pushrods, into the valve train. Similarly overhead cam engines have pivot point adjustments which have the effect of varying the effective length of the valve train length.

No matter what form the valve adjustment takes, the adjustment can be made to create exactly the right displacement "X" for the overall system created by the manufacturer. This would in all foreseeable instances involve elongating the valve train, not shortening it because in normal operation of both bleed-down and non-bleed-down hydraulic lifters, the plunger never bottoms out. It always rids somewhere up in its ample length of play within the outer cylinder. In order to make it bottom out the valve train would need to be lengthened, driving the plunger closer to the seat 30.

Figure 8:
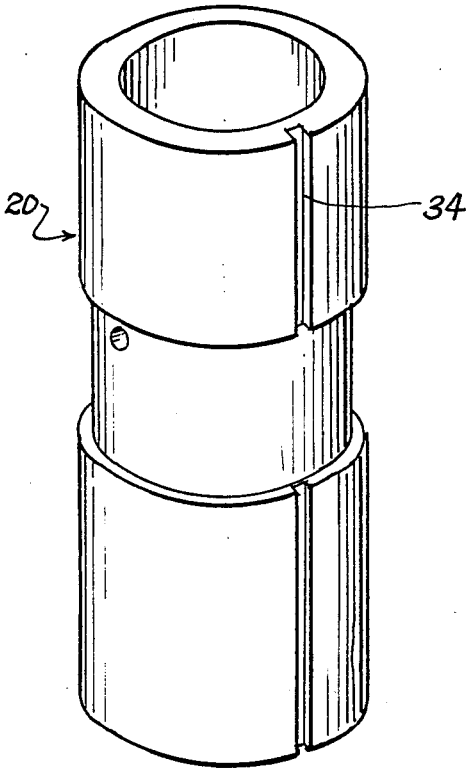

There is one last feature of the invention, constituting an improvement to the variable duration hydraulic system. This is shown in FIG. 8 and comprises a lubrication passageway defined by a groove 34 (which could also be a flat) ground into the outer cylinder 20 of the lifter. This groove can also be seen in FIGS. 1, 2, and 7. As can be seen from those figures, the groove enables oil from the oil gallery 25 to pass down to the bottom of the lifter shell, where it will lubricate the bottom of the lifter in the area where it bears on the cam lobe. It is important for any lifter, particularly bleed-down lifters which are normally used with high-performance engines, to have such lubrication to counteract any slight tendency of the system to wear due to any slight increase of valve train trauma with high-performance usage.

Although this passageway has been created in the past for the same purpose, in the prior art it does not pass all the way down the lifter cylinder to the bottom of the lifter, much less all the way to the top. By passing the passageway all the way from top to bottom, the distribution of the oil is enhanced. However, the principal advantage derived from a continuous flat lies in the ability to produce the relief (whether a groove or flat) with a single pass (or several passes) of a grinder without having to lift the grinder at the end of the relief. Whereas this may not be of major importance to large car manufacturers as they have the jigs, tooling and robotics to accommodate the making of such structure, it is important to small manufacturers in the retrofit market.

Thus with the four features described, illustrated and claimed, internal combustion engine valve art has been advanced yet another step in its long history, from mechanical lifters to hydraulic to bleed-down, and now to improved bleed-down, bringing the valve train system yet another step toward perfection.

It is hereby claimed:

1. An engine valve train which includes a valve, a cam of a cam shaft, a bleed-down variable duration hydraulic lifter riding on said cam, and connecting linkage operative between said lifter and said valve, said lifter having an outer cylindrical body riding on said cam and an inner plunger axially slidable within said cylinder body and defining an oil chamber therebetween, said outer cylindrical body defining a seat defining the lowermost position for said plunger, said valve train being characterized by said connecting linkage being of effective length dimension such that at least at low engine operating speeds below on the order of 1000 RPM, said plunger seats in said seat prior to said valve seating.

2. Structure according to claim 1 wherein said cam is asymmetric to define a closing side that differs from the opening side by being initially steeper and subsequently shallower in ramp angle.

3. Structure according to claim 1 wherein the effective length of said connecting linkage is such that when said valve is statically seated said plunger is raised on the order of 0.050 above its seat.

4. Structure according to claim 1 wherein said variable duration hydraulic lifter has a bleed passageway substantially larger in cross section than a conventional bleed passageway to accelerate the seating of said plunger.

5. Structure according to claim 4 wherein said bleed passageway comprises a groove ground on the outside of said plunger and is on the other of 0.020" wide and between 0.006" and 0.010" deep.

6. Structure according to claim 1 wherein the out cylindrical body of said lifter has a relieved external annular band connecting with an oil gallery, said lifter having a relief ground longitudinally along the entire length of said cylindrical body to define a lubrication passageway.

7. A method of quieting the valve seating noise in a valve train having a valve, a bleed-down variable duration hydraulic lifter, and a connecting linkage between said valve and lifter, said lifter having an internal plunger axially slidable in an external cylindrical body and having a lower seat therein, said method comprising the following steps:

(a) determining approximately the bleed distance the plunger bleeds down in the cylindrical body at idling speeds;

(b) adjusting said connecting linkage such that in a static mode with said valve seated, said plunger is spaced above its seat less than said bleed distance.

8. Method according to claim 7 and including the additional step of modifying said cam such that the closing ramp differs from the opening ramp by having an initially steep portion and subsequently a shallower portion, such that as engine speed increases from idle speed, the touchdown point of the lifter on the shallow portion moves from the region thereof nearer the steep portion away from the steep portion, such that the touchdown point on said closing ramp is on said shallower portion throughout the entire range of engine speeds.

9. Method according to claim 7 and including the step of grinding an elongated relief down one side of said plunger, said relief being substantially larger than the relief on a conventional bleed-down variable duration lifter to quicken the seating of said plunger in its seat.

10. Method according to claim 9 wherein said relief is a groove on the order of 0.020" wide and between about 0.006" and 0.010".

11. A hydraulic lifter having an outer cylindrical body with a relieved external annular band connecting with an oil gallery, said lifter having a relief ground longitudinally along the entire length of the cylinder body.

* * * * *